United States Patent [19]

Johnson

[11] 4,378,643

[45] Apr. 5, 1983

[54] SOLE WITH SKEWED CLEATING ARRANGEMENT

[75] Inventor: Jeffrey O. Johnson, Newton, N.H.

[73] Assignee: BRS, Inc., Beaverton, Oreg.

[21] Appl. No.: 119,377

[22] Filed: Feb. 7, 1980

Related U.S. Application Data

[63] Continuation-in-part of Ser. No. 112,842, Jan. 17, 1980, Pat. No. 4,327,503.

[51] Int. Cl.[3] ..... A43B 5/00; A43B 13/04; A43B 23/28

[52] U.S. Cl. ..... 36/129; 36/32 R; 36/59 C

[58] Field of Search ..... 36/129, 134, 32 R, 59 R, 36/59 C

[56] References Cited

U.S. PATENT DOCUMENTS

| | | | |
|---|---|---|---|
| 2,722,756 | 11/1955 | Ecclesine . | |
| 3,793,750 | 2/1974 | Bowerman | 36/59 C |
| 3,808,713 | 5/1974 | Dassler . | |
| 3,918,181 | 11/1975 | Inohara . | |
| 3,971,145 | 7/1976 | Stegerwald | 36/32 R |
| 4,083,125 | 4/1978 | Benseler et al. . | |

FOREIGN PATENT DOCUMENTS

| | | |
|---|---|---|
| 598513 | 2/1948 | United Kingdom . |
| 947651 | 1/1964 | United Kingdom . |
| 962676 | 7/1964 | United Kingdom . |
| 1152746 | 5/1969 | United Kingdom . |
| 1232365 | 5/1971 | United Kingdom . |
| 1427529 | 3/1976 | United Kingdom . |
| 1551375 | 8/1979 | United Kingdom . |

*Primary Examiner*—Patrick D. Lawson

*Attorney, Agent, or Firm*—Schuyler, Banner, Birch, McKie & Beckett

[57] ABSTRACT

Curved last soles for athletic shoes are disclosed, including one embodiment wherein cleats are arranged with gripping edges in the arch and heel that are perpendicular to the longitudinal axis passing therethrough, whereas in the toe cleats are arranged with gripping edges that are aligned in rows that are perpendicular to a line generally defining the direction of travel while the athlete abducts his or her feet during the propulsion phase of running. Cleats in the ball portion of the sole fan out to provide a smooth transition from the cleats in the arch to the cleats in the toe.

In a second embodiment the cleats are disposed throughout the sole in rows which maintain a perpendicular relationship relative to the longitudinal axis of the heel, but the orientation of the gripping edges of the cleats in the toe and ball portions are varied in such manner as to compensate for the aforementioned abducting effect. Cleats of two different heights are provided, relatively tall ones in the ball, relatively short ones in the toe and arch and both heights in the heel.

In a third embodiment especially intended for racing, the cleats are closely spaced between curved-bottom grooves in a very lightweight sole of expanded synthetic rubber. The cleats are aligned in bar-like rows which are oriented to compensate for the aforementioned abducting effect.

21 Claims, 11 Drawing Figures

FIG. 6
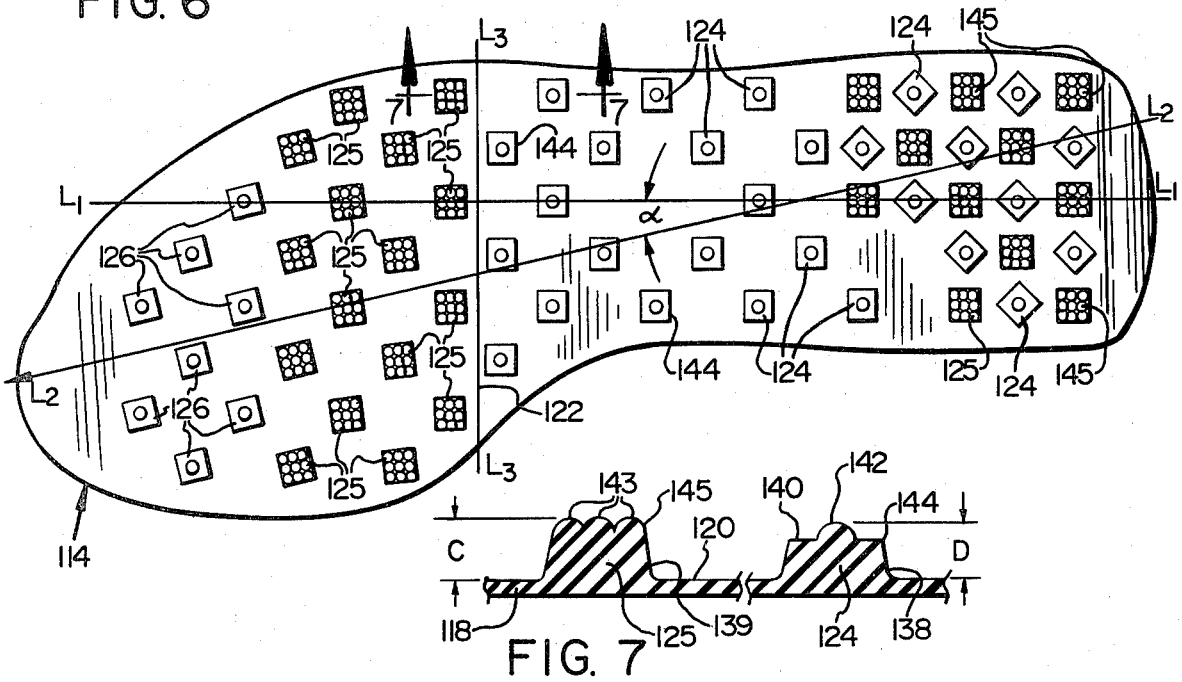
FIG. 7
FIG. 8
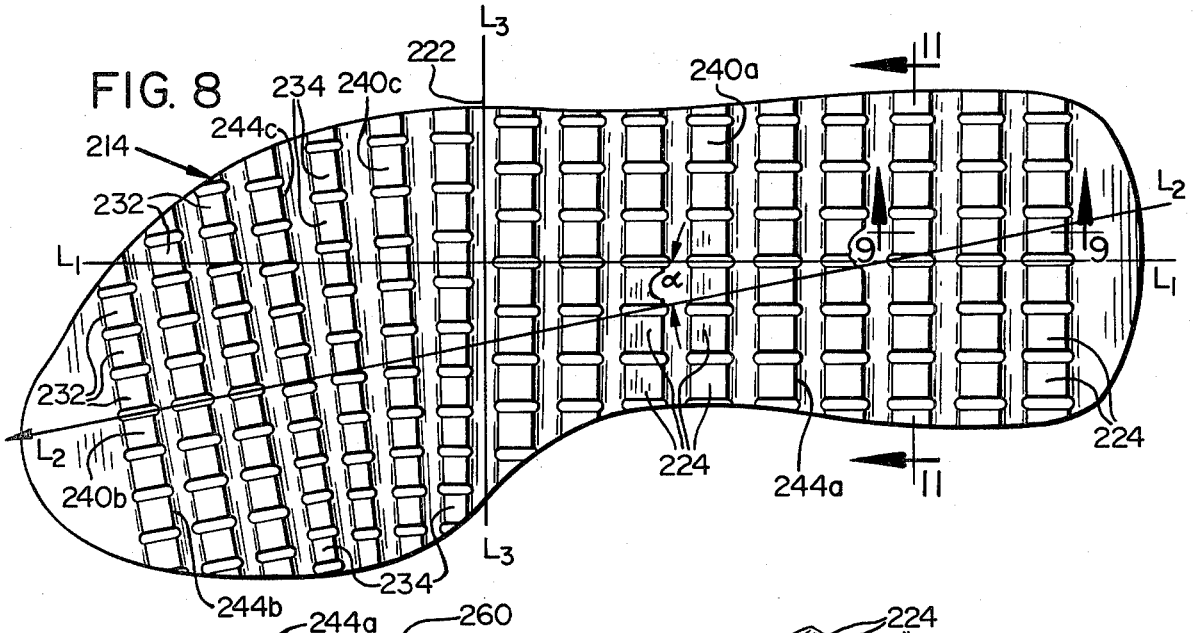
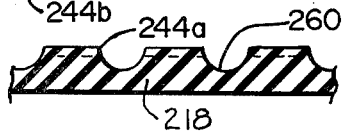
FIG. 9
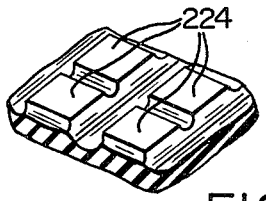
FIG. 10
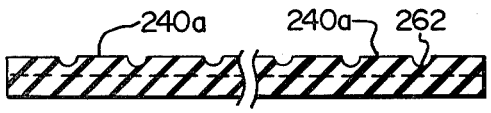
FIG. 11

SOLE WITH SKEWED CLEATING ARRANGEMENT

BACKGROUND OF THE INVENTION

This application is a continuation-in-part of commonly assigned U.S. patent application Ser. No. 112,842, filed Jan. 17, 1980, entitled OUTER SOLE STRUCTURE FOR ATHLETIC SHOE, now U.S. Pat. No. 4,327,503 the subject matter of which is incorporated by reference herein to the extent it is not inconsistent with the subject matter of this application.

The present invention pertains generally to cleated athletic shoes and more particularly to an improved arrangement and structure of cleats integrally molded with the outer sole of the shoe.

The prior art includes numerous examples of cleating arrangements on the soles of athletic shoes, some of which are disclosed in U.S. Pat. Nos. 3,793,750 and 4,098,011. In the primary embodiment of the athletic shoe disclosed in U.S. Pat. No. 3,793,750, a uniform arrangement of square-shaped cleats is provided on the bottom surface of the outer sole. All of the cleats are arranged in parallel staggered rows and the orientation of each cleat is such that its front and rear edges are aligned parallel with respect to the parallel alignment of rows.

It has been observed that most athletes tend to abduct (point their toes outward from the direction of travel) during the propulsion phase of running at a slight angle of between 10° to 4°. Accordingly, it would be desirable to provide a sole for an athletic shoe having a cleating arrangement which takes advantage of this tendency to abduct in order to maximize the effective force transfer between the foot and the ground as the athlete drives his or her body forward.

SUMMARY OF THE INVENTION

It is therefore a principal object of the present invention to provide a sole for an athletic shoe with a skewed cleating arrangement in the forefoot region of the sole wherein a plurality of gripping edges on cleats are aligned so that they tend to be substantially perpendicular to the direction of travel of the athlete while driving forward against the ground during the propulsion phase of running.

Other objects as well as various inherent advantages of the present invention will become apparent from the following description of several illustrative embodiments thereof when read in conjunction with the accompanying drawings.

BRIEF DESCRIPTION OF THE DRAWINGS

FIG. 6 is a bottom plan view similar to FIG. 2 showing a cleating arrangement in accordance with a second embodiment of the present invention.

FIG. 7 is a slightly enlarged fragmentary cross-section taken along line 7—7 of FIG. 6.

FIG. 8 is a bottom plan view similar to FIG. 2 showing a cleating arrangement in accordance with a third embodiment of the present invention.

FIG. 9 is a slightly enlarged fragmentary cross-section taken along line 9—9 of FIG. 8.

FIG. 10 is a fragmentary perspective view of a portion of the cleating arrangement shown in FIG. 8.

FIG. 11 is a slightly enlarged fragmentary cross-section taken along line 11—11 of FIG. 8.

The various parts in each of the figures are drawn essentially to scale. Although only left sole structures are illustrated, the following description and the appended claims apply as well to mirror-imaged right sole structures.

DESCRIPTION OF THE PREFERRED EMBODIMENTS

Figure 1:
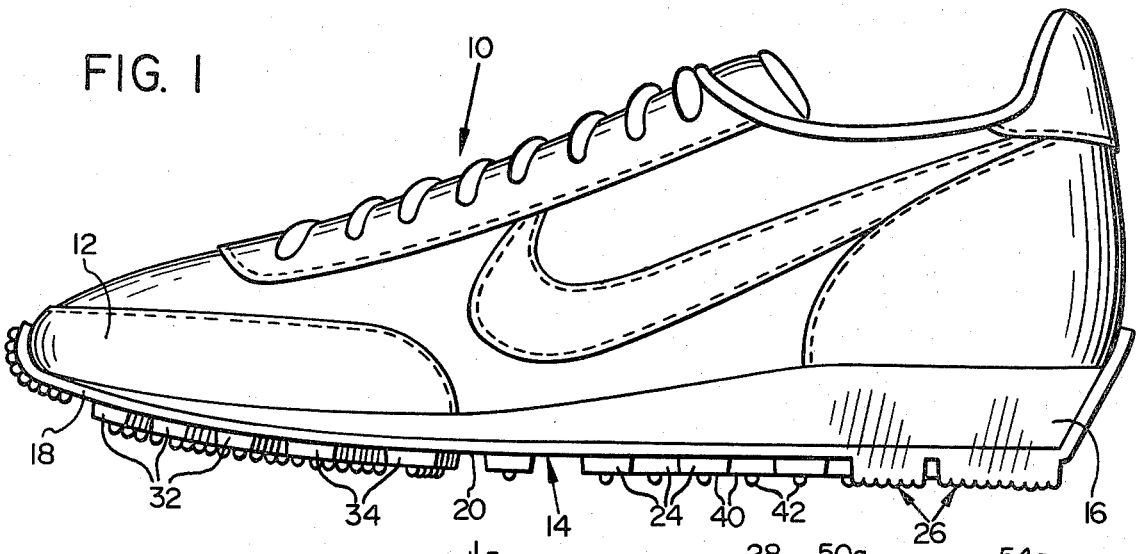
FIG. 1 is a side elevation view of an athletic shoe having a cleated sole structure in accordance with the first embodiment of the present invention looking at the outside surfaces of a left shoe.

Referring to FIG. 1, an athletic shoe in accordance with the present invention is illustrated and designated generally by reference numeral 10. The shoe 10 includes an essentially conventional shoe upper 12 which is joined to a multi-layered sole assembly including a cleated outer sole 14 and a heel lift sole layer 16. It will be appreciated that the sole layers 14 and 16 can be integrally formed as a single unit rather than being provided separately as in the present example. Since this embodiment is intended to serve as a relatively long-lived training shoe, the cleated outer sole 14 preferably comprises a relatively hard rubber or other moldable, resilient, polymeric material which is highly resistant to wear and abusive treatment. The sole 14 includes a base 18 having a major exterior surface 20. Integrally formed with and extending outwardly from the base 18 are a plurality of cleats whose structure and arrangement on the sole are depicted more clearly in FIGS. 2–5.

Figure 2:
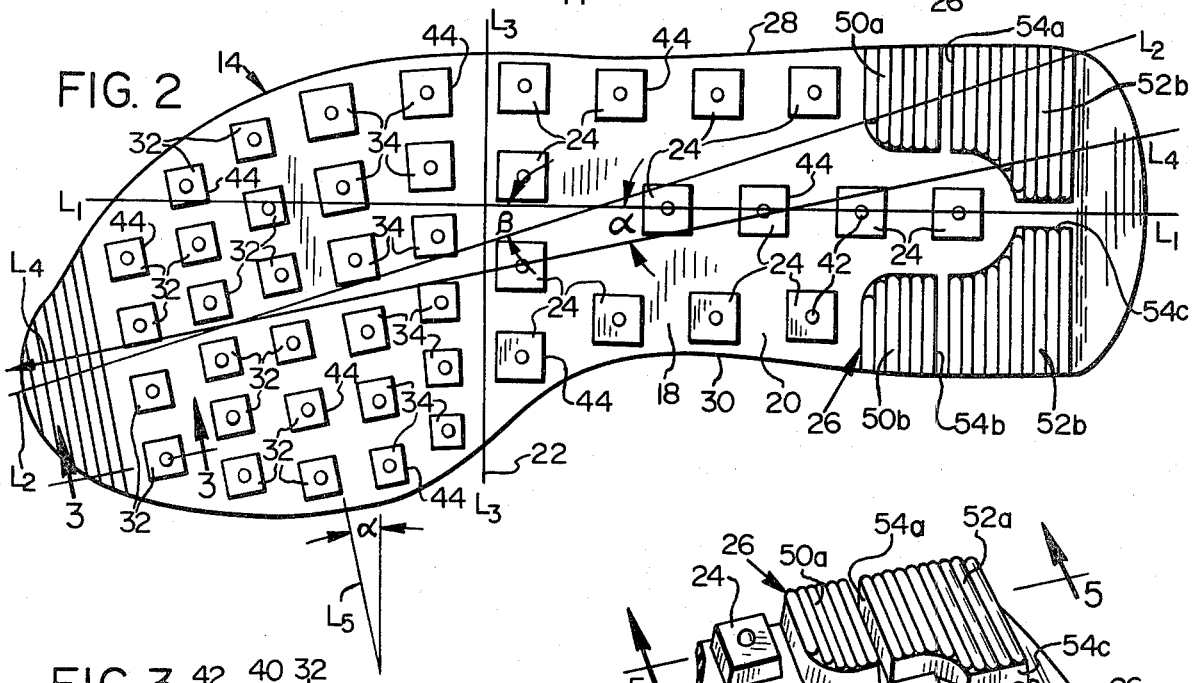
FIG. 2 is a bottom plan view of the sole of FIG. 1 showing a first preferred arrangement of cleats on the sole.

With specific reference to FIG. 2, it will be appreciated that the sole is of the curved last type wherein one longitudinal axis substantially bisects a rearfoot region as depicted by line $L_1$ and another longitudinal axis substantially bisects a forefoot region as depicted by line $L_2$. A transverse line $L_3$ is used to depict a reference plane which is designated by numeral 22. The reference plane 22 is perpendicular to the rearfoot longitudinal axis $L_1$ and divides the rearfoot and forefoot regions of the sole 14. A line $L_4$, which is drawn to the inside of the line $L_1$ in the forefoot region and intersects it in the rearfoot region, is used to depict the direction of travel of the typical athlete who abducts his or her foot during the propulsion phase of running by an angle $\alpha$ from the rearfoot longitudinal axis $L_1$.

By "propulsion phase" as used herein is meant that portion of a stride or leg cycle during which the foot is planted on the ground and the center of gravity of the athlete is ahead of the foot. In this embodiment, the angle $\alpha$ is selected to be 12° which is midway between the 10° to 14° range of foot abduction which characterizes the anatomical dynamics of most athletes during the propulsion phase of running. An angle $\beta$ is formed between the rearfoot and forefoot longitudinal axes $L_1$ and $L_2$. In a typical curved-last athletic shoe, the angle $\beta$ will be about 18°.

The rearfoot region of the sole 14 is substantially symmetrical about the $L_1$ axis and includes a plurality of first gripping cleats 24 predominently in an arch portion and a wear plug 26 occupying most of the area of a heel portion. The cleats 24 include a row of four cleats adjacent to the line $L_3$, a column of three clots along an outside edge 28, a column of three cleats along an inside edge 30 and a column of four cleats centered along the $L_1$ axis and longitudinally staggered with respect to the cleats along the sides edges. Each of the cleats 24 is preferably square in horizontal cross-section. It will be understood that horizontal as used herein means substantially parallel to the major exterior surface 20 and vertical means perpendicular thereto.

The forefoot region of the sole 14 is skewed to the inside of the $L_1$ axis and includes a plurality of second gripping cleats 32 disposed in parallel rows in a toe portion and a plurality of third gripping cleats 34 disposed in two skewed rows in a ball portion. Each of the second cleats 32 is preferably square in horizontal cross-section and each of the third cleats is preferably trapezoidal in horizontal cross-section.

Figure 3:
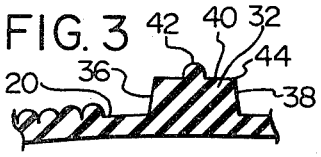
FIG. 3 is a slightly enlarged fragmentary cross-section taken along line 3—3 of FIG. 2.

Referring to FIG. 3, a cross-sectional outline of a typical cleat will be described. The cleat includes a generally forward-facing surface 36, a generally rearward-facing surface 38 and an essentially flat outer surface 40. The outer surface 40 preferably lies parallel with respect to the major exterior surface 20 and is the primary ground engaging surface of the cleat. A nipple-shaped protrusion 42 preferably extends outwardly from the outer surface 40.

In accordance with an important feature of the present invention, the orientation of the cleats 32 as depicted in FIG. 2 tends to maximize the effective force transfer between the foot and the ground for the typical athlete who toes out by about 12° during the propulsion phase of running. It will be appreciated that the rearward-facing surface 38 and the outer surface 40 of each cleat define a rearward gripping edge as typified in FIG. 3 and designated by reference numeral 44. The rearward gripping edges of the cleats 32 in the toe portion are aligned perpendicular to the direction of travel defined by the line $L_4$. Furthermore, in this embodiment, it is preferred that the gripping edges 44 in each row of cleats 32 in the toe portion of the forefoot region be colinear and project to intersect the transverse plane 22 by the angle of abduction $\alpha$. This relationship is typified by the projecting line $L_5$ in FIG. 2.

It is presently preferred that the cleats 24 in the rearfoot region of the sole 14 have their gripping edges 44 aligned substantially parallel to the transverse plane 22. Accordingly, in order to provide a smooth transition from the cleats 24 in the arch to the cleats 32 in the toe, the cleats 34 in the ball portion are arranged as two rows of edge-aligned trapezoids which become progressively smaller in moving from the outside edge 28 to the inside edge 30, thereby providing a fanned-out effect. This arrangement of trapezoidal cleats 34 not only serves to provide uniform support throughout the ball portion but also is deemed to be cosmetically pleasing. The angles by which the forward-facing and rearward-facing edges of the cleats 34 skew from parallel with respect to the transverse plane 22 vary progressively in 3° increments from 3° to 12°.

Figure 4:
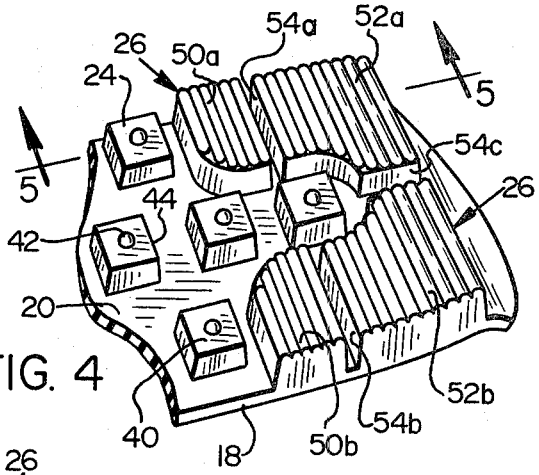
FIG. 4 is a perspective view of the heel portion of the sole of FIG. 2.

Referring now to FIG. 4, the preferred structure of the wear plug 26 will be described. The wear plug 26 is similar in function to the large-area heel cleats described in U.S. Pat. No. 4,098,011 and represents an improvement thereover. The primary function of the wear plug 26 is to add wearing surface areas at about the same or at a slightly greater vertical distance from the major exterior surface 20 as the outer surfaces 40 of the nearby cleats 24, thereby extending the useful life of the sole 14.

The wear plug 26 includes two forward, mirror-imaged segments **50*a* and 50*b* and two rearward, mirror-imaged segments 52*a* and 52*b*. Each forward segment 50*a*, 50*b* has at least about twice the ground-engaging area of one of the gripping cleats 24 in the rearfoot region. The rearward segments 52*a* and 52*b* are substantially larger than the forward segments 50*a* and 50*b*. Transversely aligned slots 54*a* and 54*b* separate respective forward and rearward segments of the wear plug 26. The slots 54*a* and 54*b* are provided in order to increase the longitudinal flexibility in the heel portion of the base 18. As a way of further increasing such longitudinal flexibility, the present invention contemplates providing additional transverse slots. For example, the rearward segments 52*a* and 52*b* could each be divided in half by transverse slots (not shown) similar to the slots 54*a* and 54*b*. Those skilled in the art will appreciate that the provision of a unitary wear plug in place of the segmented wear plug 26 would make the entire heel portion relatively inflexible and thereby tend to cause a lever action or slapping-down effect as the heel makes initial contact with the ground during running. Such lever action can cause shin splints by straining the muscles in the foreleg. The transverse slots 54*a* and 54*b* provide sufficient longitudinal flexibility in the heel portion to substantially obviate such lever action. In similar fashion, a longitudinal gap 54*c* separates the rearward segments 52*a* and 52*b*** in order to provide sufficient lateral flexibility.

Figure 5:
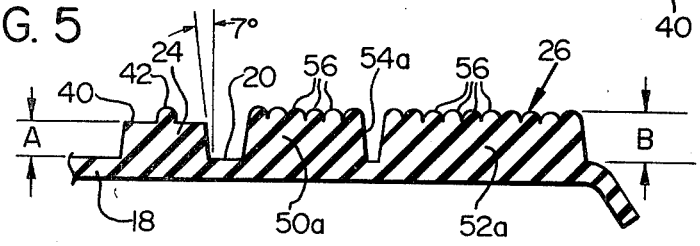
FIG. 5 is a slightly enlarged fragmentary cross-section taken along line 5—5 of FIG. 4.

Referring to FIG. 5, certain preferred dimensions will be described. Each of the cleats preferably has a vertical dimension, A, measuring about 3/16 inch from the major exterior surface 20 to the outer surface 40. The protrusion 42 extends farther outward by about 1/16 inch so that the total vertical dimension of each cleat prior to wear is about ¼ inch. The vertical dimension, B, of the wear plug 26 is preferably about ¼ inch. Thus, although the relatively small protrusions 42 will tend to wear away quickly, the surfaces 40 of at least those cleats near the wear plug 26 will tend to wear relatively slowly due to the protection afforded by the more massive wear plug 26 extending 1/16 inch farther outward. An additional preferred feature of the wear plug 26 is the provision of transversely oriented gripping ribs 56 which are semicircular in cross-section with a 1/16 inch radius. The ribs 56 extend fully across each of the four segments of the wear plug 26 to provide the entire ground-engaging surface area of the wear plug. The various outwardly-extending surfaces of the wear plug 26 and each of the cleats on the base 18 are tapered preferably at an angle of about 7° from the vertical as indicated in FIG. 5. The taper facilitates cleaning of mud and debris from the various spaces between cleats and segments of the wear plug 26. The width (longitudinal dimension) of the slots **54*a* and 54*b*** is preferably about ⅛ inch.

A second embodiment of the invention is illustrated in FIG. 6, wherein similar reference numerals are used to designate parts which are similar to previously described parts. In this sole embodiment 114, all of the cleats are square in horizontal cross-section and are arranged in rows which are aligned parallel to the transverse plane 122. Cleats of two different heights are integrally molded together with their supporting base 118 preferably using the same hard rubbery material used to fabricate the previously described embodiment.

Referring to FIG. 7, a typical cleat of each type is illustrated, one being a relatively short cleat 124 having a single central protrusion 142 and the other being a relatively tall cleat 125 having a three-by-three square cluster of nine protrusions 143. In effect, the peaks of the protrusions 143 provide the primary ground-engaging surfaces of the cleat 125 whereas the horizontal outer surface 140 provides the primary ground-engaging surface of the cleat 124. The peak vertical dimension, C, of the tall cleat 125 is preferably about 0.210 inch and the peak vertical dimension, D, of the short cleat 124 is preferably about 0.183 inch. The protrusion 142 is a hemisphere of 0.063 radius. It will be appreciated that the gripping edge 144 defined at the intersection of the rearward surface 138 and the outer surface 140 is located at a height of about 0.120 inch from the major exterior surface 120. The tall cleat 125 does not have a well-defined sharp corner to serve as a gripping edge like the edge 144 on cleat 124. However, for purposes of this specification and the appended claims, the term "gripping edge" as applied to the tall type of cleat 125 will be understood to mean those aligned points 145 at which the cleat's rearward surface 139 is tangential to the three rearmost protrusions 143.

Referring again to FIG. 6, it will be seen that the short type of cleats 124 are found in the toe, arch and heel portions of the sole 114 and the tall type of cleats 125 are found in the ball and heel portions. The short cleats 124 in the arch and the tall cleats 125 in the heel form a first group of cleats whose respective rearward gripping edges 144 and 145 are aligned perpendicular to the rearfoot longitudinal axis $L_1$. The short cleats 124 in the toe form a second group whose rearward gripping edges 144 are aligned perpendicular to the direction of travel $L_2$ while abducting the $L_1$ axis outward by the angle $\alpha$, which in this embodiment is selected to be 12°. The tall cleats 125 in the ball portion form a third group whose rearward gripping edges 145 are skewed relative to the transverse plane 122 by various angles less than or equal to the angle of abduction $\alpha$. In particular, the cleats 125 in the ball portion are arranged in four rows and the cleats in successive rows moving forwardly from the reference plane 122 are pivoted about their centers so that their gripping edges 145 are skewed respectively at 3°, 6°, 9° and 12°. The short cleats 124 in the heel form a fourth group whose edges are disposed at 45° angles to the $L_1$ axis. The purpose of this fourth group of short cleats is to provide additional wear resistance in the heel portion of the sole 114.

A third embodiment of the invention is illustrated in FIG. 8, wherein similar reference numerals are used to designate parts which are similar to previously described parts. In this sole embodiment 214, the base 218 and integrally molded cleats 224, 232 and 234 are formed from a material commonly known as foam rubber. The sole 214 of this embodiment is intended to be employed in a racing shoe and is therefore made as light as possible. Any of various expanded synthetic polymers known to those skilled in the art are suitable materials for the base 218.

Referring to FIGS. 9–11, the preferred structure of typical cleats will be described. It will be seen that the cleats are mesa-like in general appearance, each cleat being defined by curved-bottom grooves of two different depths. Relatively deep grooves 260, which are seen in cross-section in FIG. 9, extend generally transversely the entire width of the sole 214, thereby forming bar-like rows of cleats. Relatively shallow grooves 262, which are seen in cross-section in FIG. 11, separate adjacent cleats in each row. The cleats 224 in the arch and heel portions have substantially square outer surfaces **240*a* having rearward gripping edges 244*a* aligned perpendicular to the rearfoot longitudinal axis $L_1$. The cleats 232 in the toe portion, which consist of the three forwardmost rows, have generally rectangular outer surfaces 240*b* whose rearward gripping edges 244*b* are aligned perpendicular to the direction of travel $L_2$ for an angle of abduction $\alpha$ in this embodiment of 10.5°. The cleats 234 in the ball portion, which consist of the fourth through seventh rows counting from the front, have outer surfaces 240*c* which are generally trapezoidal in shape. The angles by which the forward-facing and rearward-facing edges of the cleats 234 in the ball portion skew from parallel to the transverse plane 222** vary progressively in 1.5° increments from 0° to 10.5°, thereby providing a progressively fanned-out arrangement of rows in the ball portion.

Although three preferred embodiments of the invention have been described in detail, it will be appreciated that various alternatives and modifications thereof are within the spirit and scope of the invention as defined by the appended claims.

What is claimed is:

1. A sole for an athletic shoe comprising a molded base having a forefoot region and a rearfoot region, the forefoot and rearfoot regions being separated by a transverse plane which is perpendicular to a major exterior surface of the base and to a first line which substantially bisects the rearfoot region in the longitudinal direction, a plurality of discrete cleats integrally molded to said base and extending outwardly from the major exterior surface in the forefoot region of the sole, said cleats being spaced in both the longitudinal and transverse direction of the sole, said cleats having rearwardly facing gripping edges from which projecting lines extend to intersect the transverse plane to the inside of the sole at angles which correspond in magnitude to an angle of abduction formed between the first line and a line defining the direction of travel during the propulsion phase of running by a typical athlete who abducts his or her feet slightly outward while pushing forwardly against the ground.

2. The sole of claim 1 including a plurality of discrete first cleats integrally molded to said base in the rearfoot region and extending outwardly from the major exterior surface thereof, said cleats in said forefoot region forming second cleats of said sole.

3. A sole for an athletic shoe comprising a molded base having a plurality of integrally molded cleats extending outwardly from a major exterior surface of the base including first cleats in a rearfoot region of the base and second cleats in a forefoot region of the base, the forefoot and rearfoot regions being separated by a transverse plane which is perpendicular to the major exterior surface and to a first line which substantially bisects the rearfoot region in the longitudinal direction, the first cleats having gripping edges aligned substantially parallel to the transverse plane, the second cleats having gripping edges from which projecting lines extend to intersect the transverse plane to the inside of the sole at angles which correspond in magnitude to an angle of abduction formed between the first line and a line defining the direction of travel during the propulsion phase of running by a typical athlete who abducts his or her feet slightly outward while pushing forwardly against the ground.

4. The sole of claim 3 or 2 wherein the second cleats occupy a forward portion of the forefoot region corresponding to the toes of the foot, and further comprising third cleats in a rearward portion of the forefoot region corresponding to the ball of the foot, the third cleats having gripping edges which progressively fan out to provide a smooth transition between the first and second cleats.

5. The sole of claim 4 wherein the third cleats are aligned in rows of which at least some are skewed relative to the transverse plane at angles which are smaller than the angle of abduction.

6. The sole of claim 5 wherein each row of third cleats has gripping edges which are substantially colinear.

7. The sole of claim 4 wherein the third cleats are aligned in rows which are parallel to the transverse plane and each third cleat has a gripping edge which is skewed relative to the transverse plane at an angle equal to or less than the angle of abduction.

8. The sole of claim 4 wherein the first and second cleats are square or rectangular in horizontal cross-section and the third cleats are trapezoidal in horizontal cross-section.

9. The sole of claim 4 wherein essentially all of the cleats are square in horizontal cross-section.

10. The sole of claim 4 wherein essentially all of the cleats are aligned in rows between curved-bottom grooves of a first depth extending generally transversely the entire width of the sole and wherein curved-bottom grooves of a second depth which is shallower than the first depth separate adjacent cleats in each row.

11. The sole of claim 10 wherein the base consists essentially of an expanded synthetic polymer.

12. The sole of claim 3 wherein the angle of abduction lies in the range from 10° to 14°.

13. The sole of claim 3 wherein the angle of abduction is about 12°.

14. A sole for an athletic shoe comprising an outer sole member of a resilient polymeric material having a base and a plurality of integrally molded cleats extending outwardly from the base, the base having a forefoot region corresponding to the toe and ball portions of the human foot and a rearfoot region corresponding to the arch and heel portions of the human foot, the base being characterized by a first line substantially bisecting the rearfoot region in the longitudinal direction and a second line passing through the forefoot region to the inside of the first line, the lines intersecting to form an angle of abduction between 10° and 14°, the cleats including a plurality of first cleats disposed in the rearfoot region, a plurality of second cleats disposed throughout the toe portion of the forefoot region and a plurality of third cleats disposed throughout the ball portion of the forefoot region, each of the cleats having a generally rearward-facing surface and an outer surface which meet to define a gripping edge, the gripping edges of the second cleats being substantially perpendicular to the second line.

15. The sole of claim 14 wherein the gripping edges of the first cleats are aligned substantially perpendicular to the first line, and wherein the gripping edges of the third cleats form various angles with respect to planes which are perpendicular to the first line, the various angles being less than or equal to the angle of abduction and varying to provide a fanned-out arrangement of gripping edges in the ball portion of the forefoot region.

16. The sole of claim 14 wherein the first cleats are generally uniform in size and shape and are disposed primarily in the arch portion of the rearfoot region.

17. The sole of claim 16 further comprising a wear plug disposed in the heel portion of the rearfoot region and occupying most of the area of the heel portion, the wear plug being separated into at least four segments each of which has a ground engaging area substantially larger than the area of the outer surface of one of the first cleats, the four segments of the wear plug being symmetrically disposed relative to the first line such that two segments are on each side of the first line, the segments on each side of the first line being separated by a narrow slot which is aligned perpendicular to the first line.

18. The sole of claim 14 wherein the third cleats are slightly greater in height than the second cleats.

19. The sole of claim 18 wherein the first cleats includes cleats of two different heights, the higher of which are essentially confined to the heel portion and the lower of which are disposed substantially throughout the rearfoot region.

20. An athletic shoe comprising a shoe upper, an intermediate sole joined to the upper and an outer sole joined to the intermediate sole, said outer sole being formed of a resilient polymeric material having a base and a plurality of integrally molded cleats extending outwardly from the base, the base having a forefoot region corresponding to the toe and ball portions of the human foot and a rearfoot region corresponding to the arch and heel portions of the human foot, the base being characterized by a first line substantially bisecting the rearfoot region in the longitudinal direction and a second line passing through the forefoot region to the inside of the first line, the lines intersecting to form an angle of abduction between 10° and 14°, the cleats including a plurality of first cleats disposed in the rearfoot region, a plurality of second cleats disposed throughout the toe portion of the forefoot region and a plurality of third cleats disposed throughout the ball portion of the forefoot region, each of the cleats having a generally rearward-facing surface and an outer surface which meet to define a griping edge, the griping edges of the second cleats being substantially perpendicular to the second line, said second cleats being aligned in a plurality of transverse rows substantially perpendicular to the second line, said third cleats being aligned in rows and having a cross sectional area which progressively decreases from the outer edge of the sole to the inner edge of the sole in each respective row of third cleats.

21. The athletic shoe of claim 20 wherein said second cleats have a generally square cross-sectional configuration and said third cleats have a generally trapezoidal cross-sectional configuration.

* * * * *

UNITED STATES PATENT AND TRADEMARK OFFICE

CERTIFICATE OF CORRECTION

PATENT NO. : 4,378,643

DATED : April 5, 1983

INVENTOR(S) : Jeffrey O. Johnson

It is certified that error appears in the above—identified patent and that said Letters Patent is hereby corrected as shown below:

In Column 3, line 4, change "clots" to read --cleats--.

Signed and Sealed this

*Twenty-first* Day of *June 1983*

[SEAL]

*Attest:*

DONALD J. QUIGG

*Attesting Officer*

*Acting Commissioner of Patents and Trademarks*